US012654083B2

(12) United States Patent
Brasseur et al.

(10) Patent No.: US 12,654,083 B2
(45) Date of Patent: Jun. 16, 2026

(54) SENSOR BACKSTOP SYSTEM

(71) Applicants: Johnathon P. Brasseur, Barrington, NH (US); Heather E. Brasseur, Barrington, NH (US)

(72) Inventors: Johnathon P. Brasseur, Barrington, NH (US); Heather E. Brasseur, Barrington, NH (US)

( * ) Notice: Subject to any disclaimer, the term of this patent is extended or adjusted under 35 U.S.C. 154(b) by 330 days.

(21) Appl. No.: 18/491,155

(22) Filed: Oct. 20, 2023

(65) Prior Publication Data

US 2024/0131409 A1 Apr. 25, 2024
US 2024/0226688 A9 Jul. 11, 2024

Related U.S. Application Data

(60) Provisional application No. 63/417,866, filed on Oct. 20, 2022.

(51) Int. Cl.

*A63B 69/36* (2006.01)
*A63B 24/00* (2006.01)
*A63B 69/00* (2006.01)

(52) U.S. Cl.

CPC ..... *A63B 69/0097* (2013.01); *A63B 24/0021* (2013.01); *A63B 69/0002* (2013.01); *A63B 2024/004* (2013.01); *A63B 2024/0043* (2013.01); *A63B 24/0084* (2013.01); *A63B 2069/0006* (2013.01); *A63B 2069/0008* (2013.01); *A63B 2220/10* (2013.01); *A63B 2220/36* (2013.01); *A63B 2220/833* (2013.01); *A63B 2225/20* (2013.01); *A63B 2225/74* (2020.08)

(58) Field of Classification Search

CPC ..... A63B 69/0097; A63B 24/0021; A63B 69/0002; A63B 24/0084; A63B 2024/004; A63B 2024/0043; A63B 2069/0006; A63B 2069/0008; A63B 2220/10; A63B 2220/36; A63B 2220/833; A63B 2225/20; A63B 2225/74; A63B 2102/14; A63B 2220/805; A63B 2220/808; A63B 71/022; A63B 2071/0625; A63B 2071/0694; A63B 2102/02; A63B 2102/24; A63B 2225/50; A63B 2220/89

USPC ..... 473/421, 422, 425

See application file for complete search history.

(56) References Cited

U.S. PATENT DOCUMENTS 4,222,563 A * 9/1980 Heftler ..... A63B 60/06 273/DIG. 26
5,419,549 A * 5/1995 Galloway ..... A63B 47/002 273/374
6,551,205 B1 4/2003 Koelzer, Jr. et al.
(Continued)

OTHER PUBLICATIONS https://practicesports.com/product/radar-pitching-trainer-rpt1000/ at least as early as Sep. 1, 2023.

*Primary Examiner* — Nini F Legesse
(74) *Attorney, Agent, or Firm* — Secant IP, PLLC

(57) ABSTRACT

A training device for baseball and other sports includes layers for detecting different zones of contact. The device can detect position of impact and the velocity of impact of an object such as a baseball, lacrosse ball or hockey puck by a change in voltage due to the compression or pressuring of an interlayer positioned between two conductors. The device is used for individual training as well as for competition over a network.

20 Claims, 5 Drawing Sheets

(56) References Cited

U.S. PATENT DOCUMENTS

| | | | | |
|---|---|---|---|---|
| 6,554,284 | B2 * | 4/2003 | Chou | A63B 63/00 473/192 |
| 8,096,900 | B2 | 1/2012 | Håseth | |
| 8,376,852 | B2 * | 2/2013 | Kao | A63F 9/24 463/2 |
| 9,457,251 | B2 | 10/2016 | Thurman | |
| 2005/0187036 | A1 | 8/2005 | Ziola et al. | |
| 2008/0200285 | A1 * | 8/2008 | Haseth | A63B 63/00 473/422 |
| 2013/0157788 | A1 * | 6/2013 | Moore | A63B 63/00 463/3 |

* cited by examiner

SENSOR BACKSTOP SYSTEM

RELATED APPLICATIONS

The application claims benefit of U.S. Provisional Application No. 63/417,866, filed Oct. 20, 2022 and titled IN THE ZONE; SENSOR TARGET SYSTEM, the contents of which are hereby incorporated by reference herein.

FIELD OF THE DISCLOSURE

The present disclosure relates generally to athletic training aids and more specifically to a training system for evaluating throwing, shooting and kicking accuracy and velocity.

BACKGROUND

Athletes often train with devices that are designed to improve accuracy, speed and balance. For example, for baseball pitchers there are backstops that indicate to the pitcher when a pitch is a ball or a strike. There are also radar guns and radar systems available that provide the speed of pitches. However, existing systems don't provide integrated systems that in a single platform can provide information on specific location of impact as well as velocity.

BRIEF DESCRIPTION OF THE DRAWINGS

In the figures.

Figure 1:
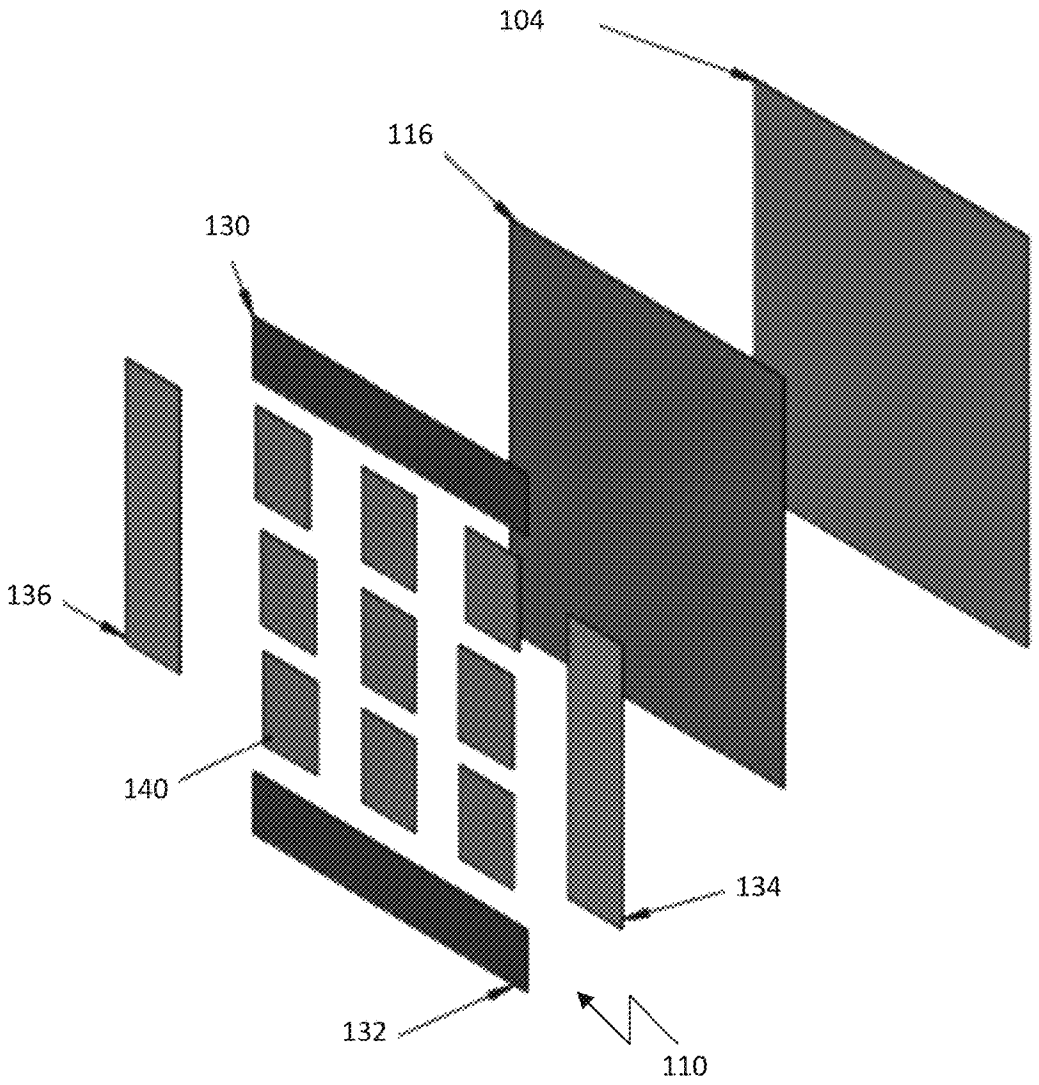
FIG. 1 is an exploded view of embodiment designed for baseball.

The figures depict various embodiments of the present disclosure for purposes of illustration only. One skilled in the art will readily recognize from the following discussion that alternative embodiments of the structures and methods illustrated herein may be employed without departing from the principles described herein.

DETAILED DESCRIPTION

Disclosed is a training device and system for sports such as baseball, hockey, lacrosse and tennis. The device can indicate and record position and velocity of impact with a ball, puck or other sports object. The device can be a backstop and need not rely on radar, optical or audio inputs. The system can record data including user, position of impact, momentum or velocity of impact, date, time of day, distance from target and weather status. The data can be incorporated into a training system that can be controlled by the user, a parent or a coach for example. The system can be connected to a network such as the internet that allows the user to compare and compete with other users on a recorded basis or in real time.

OVERVIEW

In one aspect, a device is described that provides a training platform for athletes. The device, referred to herein as a backstop, can be in communication with a microprocessor that controls indicators, records results, and/or communicates with mobile devices and a network. The device has a front surface that faces the athlete. The front surface can be divided into zones that can record the amount of force at impact. The force can be determined by the amount that a resilient insulating layer is compressed or pressured by the impact of the sports object that impacts the device. The device can include two conductive layers that are separated by a non-conductive, piezoresistive, or variable conductivity layer. This layer is referred to herein as the separating layer. At least one of these layers and the separating layer can be flexible. An electric field is applied between the conductive layers and the voltage and/or capacitance monitored. The electrical properties change with a change in the distance between the conductive layers or with a change in pressure between the conductive layers. When impacted by an object, the separating layer is compressed or pressured, and the voltage, resistance and/or capacitance, changes. The change is recognized by a microprocessor and the microprocessor calculates the velocity at impact given the mass of the object. The layers are compressed only momentarily, for example less than one second, and then rebound to their initial position. The layers or a layer can be divided into zones. The zones may be on the front layer, the rear layer, or both. In some cases only a single zone will be affected by an impact. In other cases, multiple zones can be affected. In cases where multiple zones are affected, the microprocessor can determine where the impact occurred by evaluating the change in electrical properties (e.g., voltage) in the affected zones. For instance, if the change is equal in two adjacent zones, then the microprocessor will report that the impact took place at the junction of the two zones.

The system can be controlled by a user through the microprocessor and an associated controller. Alternatively, the system can be controlled remotely through a device, such as a mobile phone, that can communicate with the microprocessor over a wireless network such as Bluetooth or wifi. The user has the ability to record results on their device, change parameters of the system, and interact with others on a network.

Example Structures and Methodologies

FIG. 1 illustrates a specific embodiment of the backstop designed for baseball. The exploded view provided in FIG. 1 includes a front conductive layer 104, a separating layer 116 and a rear conductive layer 110. Rear conductive layer 110 is divided into 13 different zones including upper ball zone 130, lower ball zone 132, outside ball zone 134, inside ball zone 136 and strike zone 140. Note that there are 9 different strike zones that can be divided into upper, lower, inner, outer, and center zones, or combinations thereof. The voltage between front conductive layer 104 and each of the zones can be measured independently by, for example, a voltage filter or other voltage measuring device. Separating layer 116 can be a layer of resilient material that can be compressed when impacted by an object. Alternatively, the layer may be of a material that changes in resistance when pressure is applied. As used herein, a material is "resilient" if it can be compressed by at least 10% by a baseball at 60 mph and returns to its original thickness after the ball drops off, or bounces off, the surface. A layer is "non-conductive" if it does not short the electrical connection between the front and rear layers when in contact with both. A layer is of variable conductivity if it changes resistance with a change in thickness or compression. A layer is piezoresistive if its resistance changes under pressure. The resilient material can be a non-conductive material such as a fabric, a polymer layer or a contained layer of air or other gas. Examples of variable conductivity layers include extruded polymer sheets such as polymers containing carbon particles, for example, polyethylene with carbon particles therein. The carbon particles may be, for example, carbon black or graphene. Polymer layers include extruded materials as well as closed cell and open cell foam layers. The separating layer can have a thickness adequate to provide a measurable change in voltage when impacted by a sports object. In different embodiments, the thickness of the separating layer can be, for example, less than 3 inches, less than 1 inch, less than ½ an inch, less than a ¼ of an inch, less than ⅛ inch, less than 0.050 inch, less than 0.025 inch, greater than 1/10 of an inch, greater than ¼ of an inch, greater than ½ an inch or greater than 1 inch. In certain embodiments, the resilient separating layer, when struck by a baseball at 60 mph, is compressed by at least 10%, at least 25% or at least 50%. In one embodiment the separating layer is Velostat having a thickness of 0.008 inches.

The backstop can include a stiff, hard backing to assure that proper compression of the front layer and the separating layer occurs. In some embodiments the backstop can be mounted in front of a solid surface, such as a wall. In other embodiments the backstop itself may include a stiff layer, such as a stiff polymer layer or plywood. The backstop can include a frame that allows it to be erected on the ground. In other embodiments it can be hung from a wall or other structure. A frame can allow the backstop to be oriented at different angels should that be desired.

Figure 2:
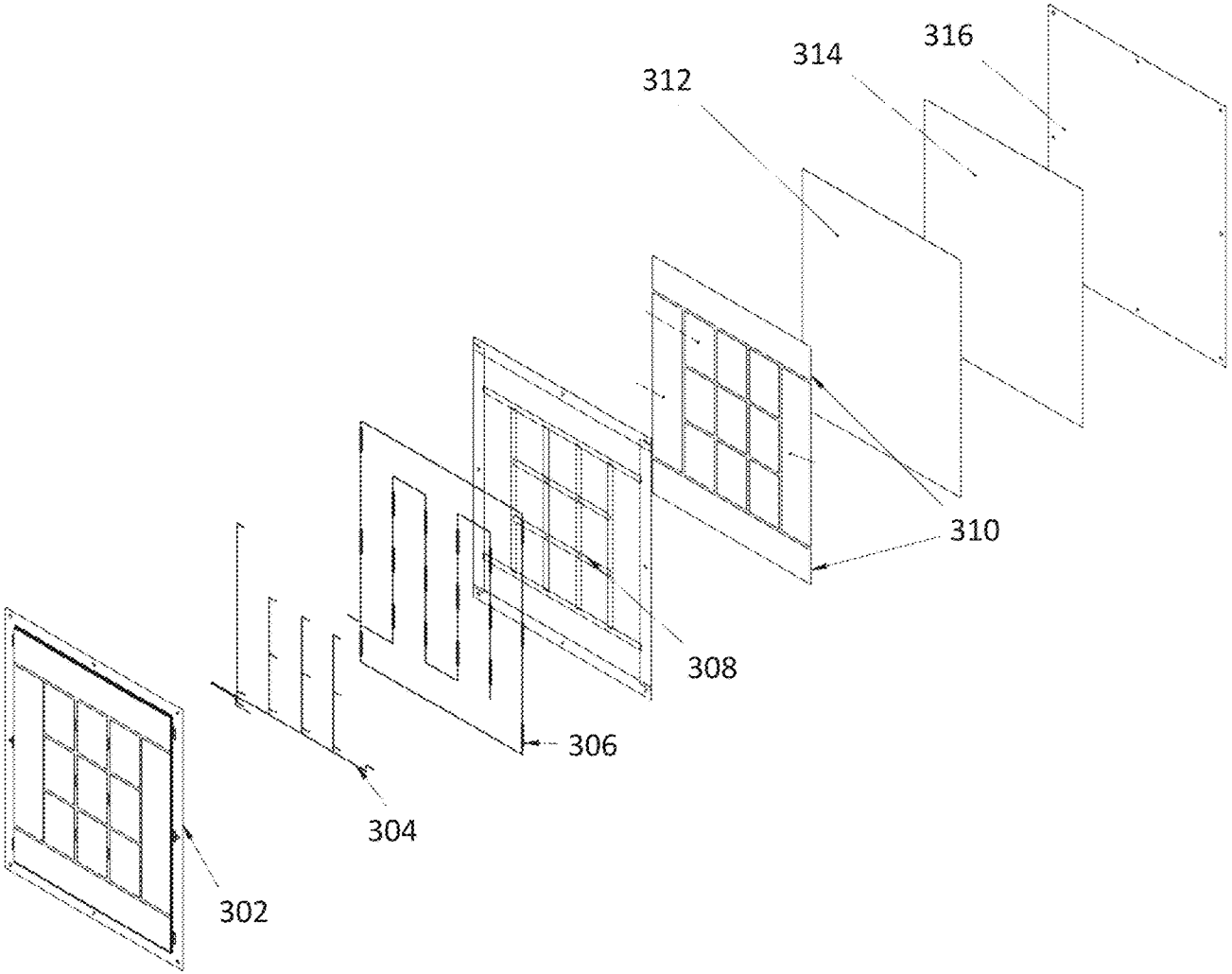
FIG. 2 is an exploded view of the construction of one embodiment of a backstop.

FIG. 2 shows an exploded view of a backstop system for baseball. Front facing layer 302 includes transparent or translucent windows for displaying LEDs that are behind it. It is divided into zones indicating zones for strikes and balls and specific zones within the strike zone. Layer 304 is a wiring harness with a conductive lead corresponding to each zone. Layer 306 is an LED wiring harness that includes a light for each of the zones and sub-zones. The lights can be illuminated when a zone or sub-zone is impacted. In some embodiments the lights can be illuminated prior to the pitch to provide a specific target. Layer 308 is an insulating layer that electrically divides the zones of layer 310. Layer 310 includes a conductive portion for each zone and is electrically connected to a device for measuring voltage. Layer 312 is separating layer, in this case Velostat piezoresistive polyethylene. Layer 314 is a common electrically conductive layer that forms a voltage with each of the zones of layer 310. When layer 312 is compressed in a particular zone, the voltage across that particular zone changes and is recognized by the microprocessor. Layer 316 is a protective back layer and in this case is a vinyl layer sewn to the stack of functional layers.

Figure 3A:
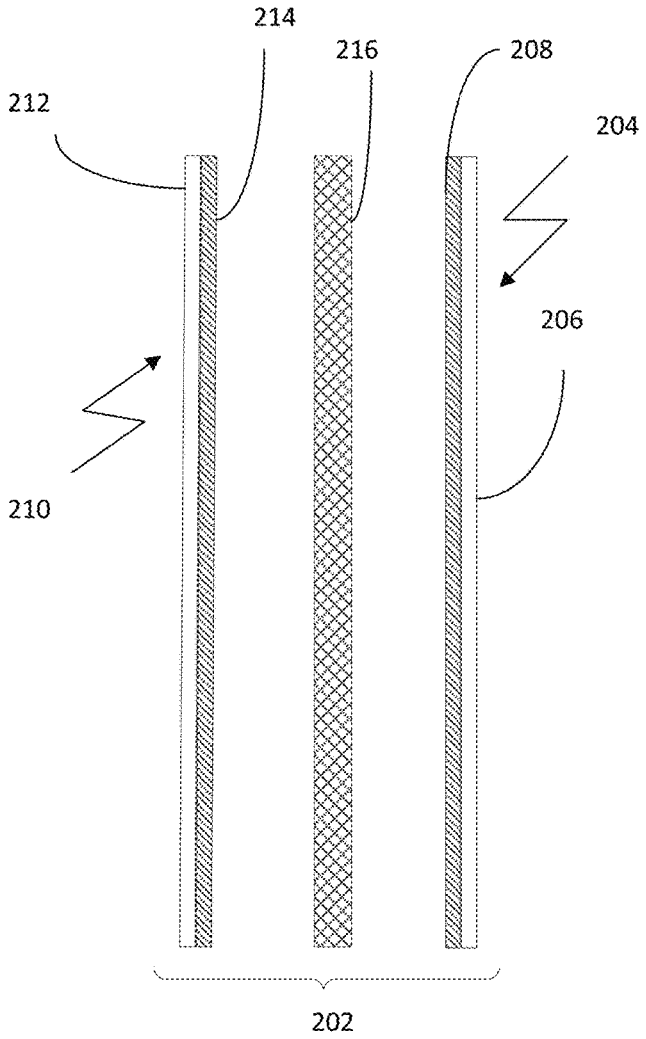
FIGS. 3*a*-3*d* are cross-sectional views of one embodiment illustrating compression of the components of the backstop.

FIGS. 3*a*-3*d* show different cross-sectional views of a particular embodiment. Note that different layers may not be to scale. FIG. 3*a* provides an unassembled cross-sectional view of a backstop 202. Front layer 204 includes front surface 206 and conductive layer 208. Front layer 204 is flexible so that it moves when impacted by a sports object such as a baseball. In some cases, front layer 204 can include a single layer of conductive material 208. Front surface 206 and conductive layer 208 may be two independent materials or may be adhered together. Front surface 206 can include indicia such as targets, strike zones or images of goalies. The indicia may or may not correspond to zones in the backstop. The indicia can be illuminated in response to a zone being impacted or can be illuminated to provide a target for a thrower or shooter. Conductive layer 208 can be, for example, a conductive fabric or a substrate with conductive traces such as metal leads. Conductive layer 208 may be a single conductive region or may be divided into electrically independent zones. In either case, the conductive layer can be electrically connected to a power source, a voltage measurement device, and a microprocessor, for example by wires. Separating layer 216 provides an active electrical barrier between conductive layers 208 and 214. It can be of consistent thickness and resistivity throughout or can have regions of greater or lesser thickness or electrical insulation. A material is deemed to be of consistent thickness if its thickness varies by less than 10% across the active part of the layer. Rear layer 210 can include conductive layer 214 and backing material 212. In some embodiments, the backing material can be conductive and rear layer 210 is a homogenous material comprising a stiff, conductive material. Conductive layer 214 can be divided into zones by including breaks between zones that provide electrical insulation to electrically separate the zones.

Figure 3B:
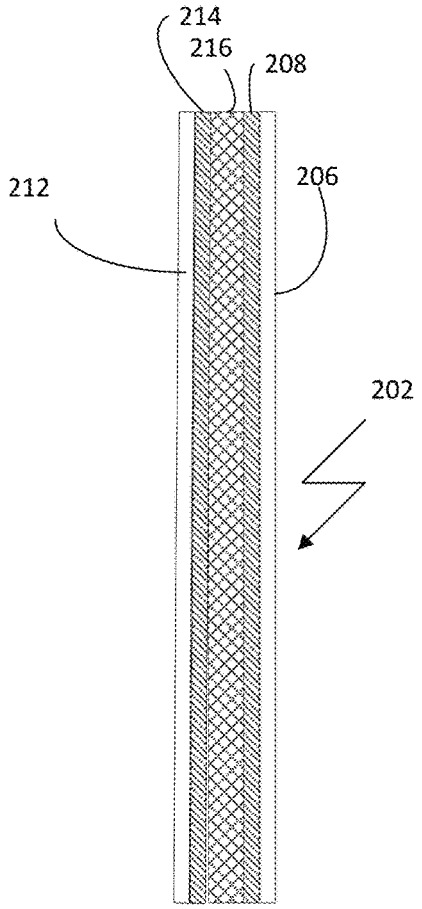

FIG. 3*b* shows the components of FIG. 3*a* in an assembled form. As shown, the different layers are in contact with adjacent layers, but they need not be in all embodiments. Layers may be adhered to each other such as by sewing or with an adhesive.

Figure 3C:
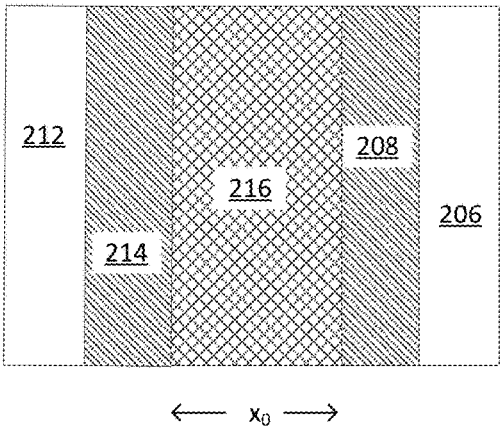
Figure 3D:
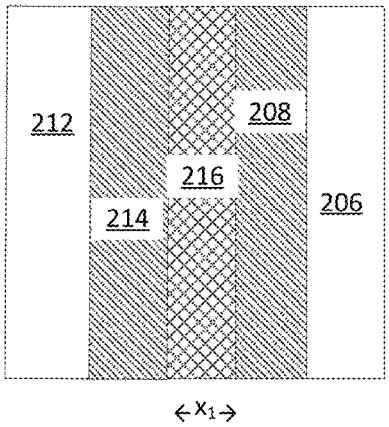

FIG. 3*c* provides a view of one zone of the backstop of FIGS. 3*a* and 3*b*. In comparison, FIG. 3*d* provides a view of the same zone of the backstop when impacted by an object. In comparing the two views, note that the thickness (X) of separating layer 216 has been reduced from $X_0$ in FIG. 3*d* to $X_1$ in FIG. 3*d*. This has reduced the distance between conductive layers 208 and 214 resulting in a change in voltage. In other embodiments the separating layer is subjected to pressure without a significant or detectable change in thickness. The resulting change in voltage can be detected and signals the impact of an object in the zone. Note that layers 206, 208, 214 and 212 retain their thicknesses between the two views. In other embodiments, one, two or more of these layers can also be moved or compressed. For example, layers 206 and 208 can be flexible materials and can be shifted to the left by impact of the object. In other embodiments these layers may be compressible, and their thickness may be reduced as a result of the impact. Following the impact, the backstop material returns to its initial position shown in FIG. 3*c*.

The backstop can be electrically connected to a microprocessor, a power source and a network. The microprocessor can detect a voltage change (e.g., voltage drop) in a particular zone and can provide an indication as to which zone was struck. For example, if the microprocessor detects a voltage change in the lower outside strike zone then it can: 1) illuminate a light on the backstop in the particular zone that was struck; 2) illuminate the zone on a display or personal device; 3) record the position of the impact in a database; 4) initiate a sound indicating a strike or 5) update the status of a game being played by the user. The microprocessor can also calculate the velocity at which the object strikes the backstop. For example, if the backstop is being used to train a baseball pitcher, the microprocessor is programmed to know that the object has a mass of 5 ounces. At the point of minimum distance between the two conductive layers the voltage (or capacitance for example) is recorded. The difference between the recorded voltage and the voltage prior to impact is directly proportional to the momentum of the object impacting the backstop. This relationship can be found empirically or by knowing the compression curve of the material that comprises the separating layer. Knowing the weight of the object being thrown, the system can use the momentum of that object to calculate the velocity at impact.

That velocity can be displayed on the backstop, on a separate display, on a local or remote device, or can simply be stored in a database. The system can also include the number of pitches thrown in a session. The system may include user inputs such as name, date, time and distance from the backstop as well as whether or not the pitch is thrown from flat ground or a mound.

Figure 4:
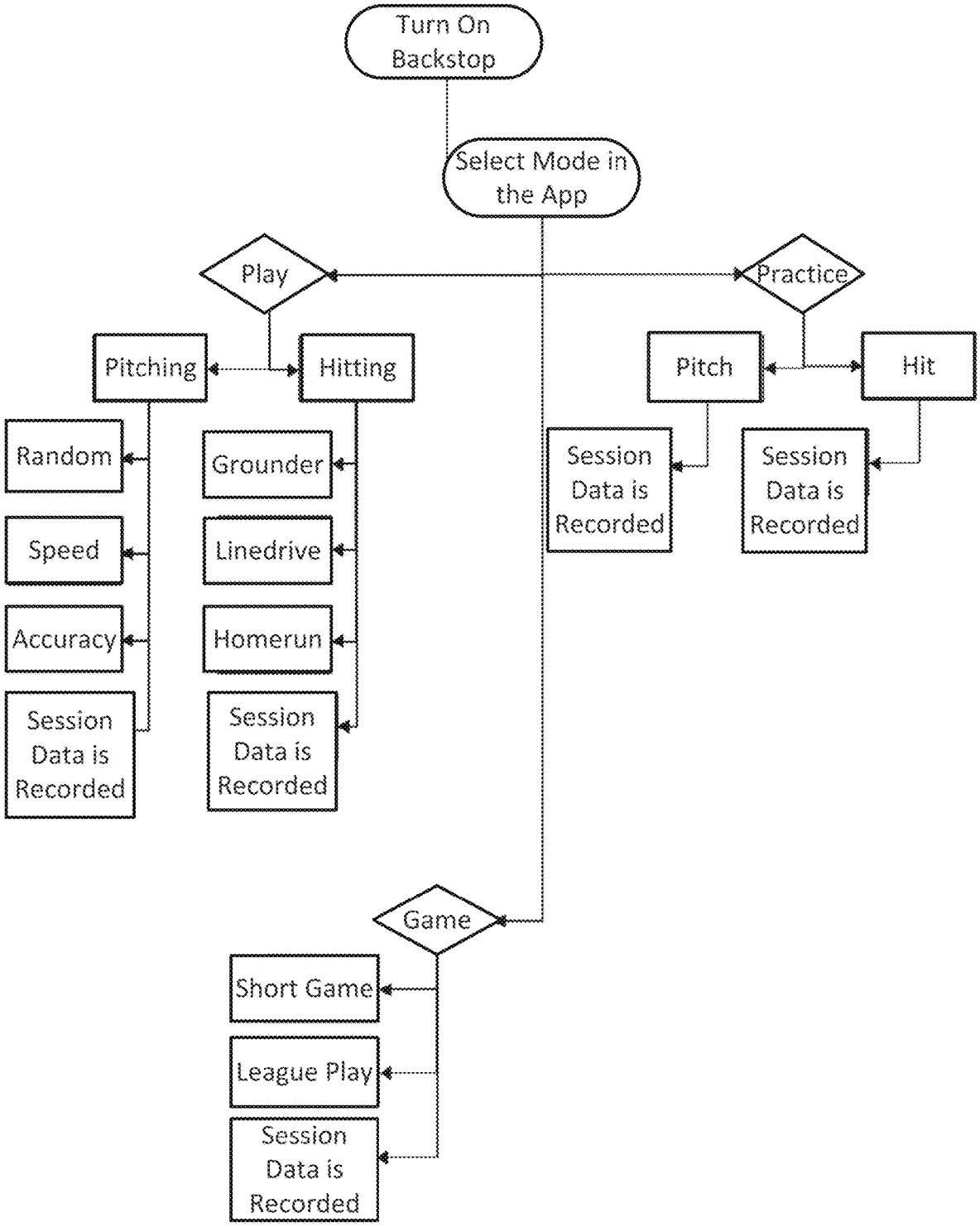
FIG. 4 is a flow chart showing operation of one embodiment.

FIG. 4 provides a flow chart indicating several embodiments of using the backstop. After turning the system on, an app allows the user to select a mode, such as "training" or "practice." In training mode, the user can select either pitching or hitting. Then specific skills can be worked on, such as speed or accuracy. The system may also be set to provide random skill selection. In hitting mode, the backstop can indicate where and how hard the backstop has been impacted. This information can result in the system indicating, for example, grounder, line drive or home run, as well as the area in the field to which the ball has been hit. All data can be recorded. In practice mode, the user can select either pitching or hitting and the system records subsequent data such as position and velocity of pitches and hits. This data can then be accessed over the internet by the user, parents and coaches.

Figure 5:
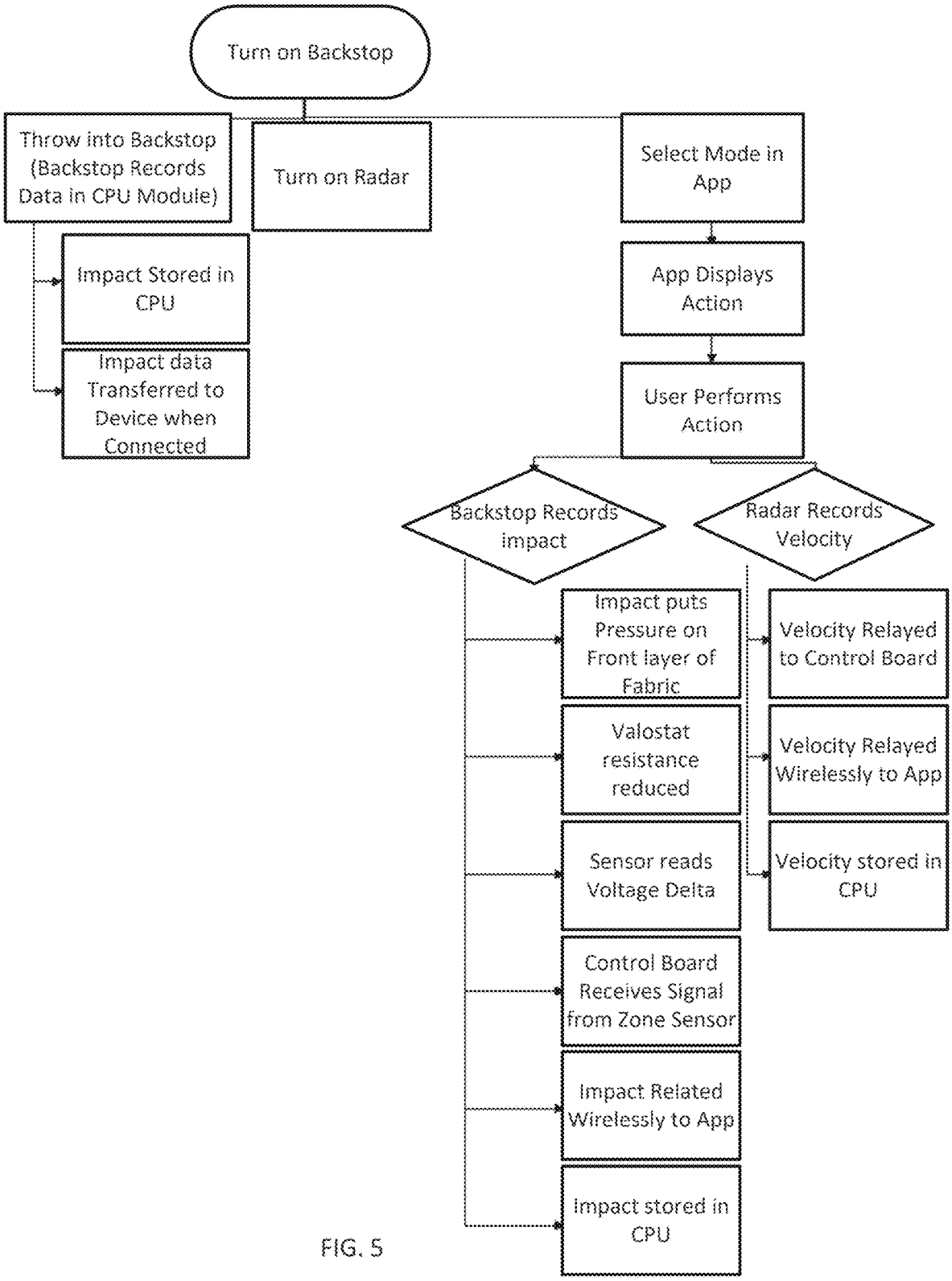
FIG. 5 is a flow chart showing operation of another embodiment.

FIG. 5 provides a flow chart that illustrates an embodiment using the backstop in conjunction with radar for measuring velocity. This can also be used for calibrating the backstop to determine velocity in the absence of radar. First, the backstop and radar are turned on. A throw is made, and the system records the position of the impact and the velocity. These data are stored and transferred to a connected device. A particular mode can be selected in the app. The app displays a particular action, and the user performs that action. For example, the app may say "lower, inside corner" and the user will try to pitch to the lower inside corner. Upon impact of the throw, the area of impact is compressed or pressured, and the system detects the position of impact. The corresponding velocity is received from radar or from the amount of compression of the separating layer. The results are relayed by the microprocessor to one or more devices and are also stored. In this manner, the user has a record of accuracy and speed achieved during training.

EXAMPLES

In a first example, a backstop is provided, the comprising a first flexible conductive layer comprising a plurality of zones, a second flexible conductive layer, a separating layer separating the first conductive layer and the second conductive layer in each of the plurality of zones, and a voltage filter for measuring a voltage across the first flexible conductive layer and the second flexible conductive layer in each of the plurality of zones, wherein in a first unbiased position, one of the plurality of zones exhibits a first voltage and in a second biased position after being struck by an object the one of the plurality of zones exhibits a second voltage that is different from the first voltage.

In a second example the backstop of example 1 includes a microprocessor for detecting a change in voltage in one or more zones and indicating to a user the change in voltage.

In a third example the microprocessor determines the velocity of the object by comparing the second voltage to the first voltage.

In a fourth example the microprocessor indicates to a user which zone or zones of the plurality of zones was struck by the object.

In a fifth example only a single zone registers a voltage change when struck by the object.

In a sixth example two or more zones can simultaneously register a voltage change when struck by an object.

In a seventh example one or more of the plurality of zones includes an indicator light in the region of the one or more of the plurality of zones.

In an eighth example the first voltage and the second voltage are both non-zero.

In a ninth example the separating layer is adhered to one or both of the first flexible conductive layer and the second flexible conductive layer.

In a tenth example the backstop has at least 10 zones.

In an eleventh example the backstop has at least 4 zones.

In a twelfth example the second flexible conductive layer is not divided into zones.

In a thirteenth example the backstop returns to the first unbiased position after the object leaves the backstop.

In a fourteenth example the backstop includes a support frame for suspending the backstop.

In a fifteenth example the backstop includes a control box containing the microprocessor and a power source.

In a sixteenth example the backstop includes memory storage.

In a seventeenth example the momentum of an object hitting the backstop is proportional to the difference between the first voltage and the second voltage.

In an eighteenth example the backstop includes indicator lights controlled by the microprocessor.

In a nineteenth example the separating layer comprises a piezoresistive material.

In the twentieth example the separating layer comprises a resilient material.

The twenty first example is a method of measuring velocity and accuracy of a sports object where the method includes propelling a sports object at a backstop, impacting the backstop with the sports object, compressing or pressuring a separating layer between two conductive layers as a result of impacting the backstop, changing a voltage between the two conductive layers in an area of impact, determining the position of impact and the velocity of the object at time of impact using the change in voltage, and reporting at least one of the positions and the velocity of the impact to a user.

Example 22 is the method of example 21 where the backstop comprises a plurality of zones and the impact registers a voltage change in at least one zone and does not register a voltage change in a at least one other zone.

Example 23 is the method of example 21 where reporting includes at least one of activating a light, activating a sound and recording data.

Example 24 is the method of example 21 where at least one of the two conductive layers includes indicia for a sport selected from baseball, hockey, soccer, tennis, golf, field hockey and football.

Example 25 is the method of example 21 where the voltage is $V_1$ before impact, is $V_2$ at the point of maximum compression of the electrical insulating layer and at $V_1$ after the sports object leaves the backstop and $V_1 \neq V_2$.

Example 26 is the method of example 21 where the method is repeated a second time and the voltage is $V_1$ before impact, is $V_3$ at the point of maximum compression of the electrical insulating layer and is $V_1$ after the sports object leaves the backstop and $V_2 \neq V_3$.

Example 27 is the method of example 21 where the position and velocity information are transmitted over a computer network.

Example 28 is the method of example 21 where at least one of position data and velocity data are stored.

Example 29 is the method of example 21 where the data are stored locally in memory that is in electrical communication with the backstop.

Example 30 is the method of example 21 where the data are stored remotely.

Example 31 is the method of example 21 where the pressure on the separating layer is at least doubled on impact.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A backstop comprising:

a first flexible conductive layer comprising a plurality of zones;

a second flexible conductive layer;

a separating layer separating the first conductive layer and the second conductive layer in each of the plurality of zones; and a voltage filter for measuring a voltage across the first flexible conductive layer and the second flexible conductive layer in each of the plurality of zones, wherein in a first unbiased position, one of the plurality of zones exhibits a first voltage and in a second biased position after being struck by an object the one of the plurality of zones exhibits a second voltage that is different from the first voltage.

2. The backstop of claim 1 comprising a microprocessor for detecting a change in voltage in one or more zones and indicating to a user the change in voltage.

3. The backstop of claim 2 wherein the microprocessor determines the velocity of the object by comparing the second voltage to the first voltage.

4. The backstop of claim 2 wherein the microprocessor indicates to a user which zone or zones of the plurality of zones was struck by the object.

5. The backstop of claim 2 comprising a control box containing the microprocessor and a power source.

6. The backstop of claim 2 comprising indicator lights controlled by the microprocessor.

7. The backstop of claim 1 wherein only a single zone registers a voltage change when struck by the object.

8. The backstop of claim 1 wherein two or more zones can simultaneously register a voltage change when struck by an object.

9. The backstop of claim 1 wherein one or more of the plurality of zones includes an indicator light in the region of the one or more of the plurality of zones.

10. The backstop of claim 1 wherein the first voltage and the second voltage are both non-zero.

11. The backstop of claim 1 wherein the separating layer is adhered to one or both of the first flexible conductive layer and the second flexible conductive layer.

12. The backstop of claim 1 having at least 10 zones.

13. The backstop of claim 1 having at least 4 zones.

14. The backstop of claim 1 wherein the second flexible conductive layer is not divided into zones.

15. The backstop of claim 1 wherein the backstop returns to the first unbiased position after the object leaves the backstop.

16. The backstop of claim 1 comprising a support frame for suspending the backstop.

17. The backstop of claim 1 comprising memory storage.

18. The backstop of claim 1 wherein the momentum of an object hitting the backstop is proportional to the difference between the first voltage and the second voltage.

19. The backstop of claim 1 wherein the separating layer comprises a piezoresistive material.

20. The backstop of claim 1 wherein the separating layer comprises a compressible material.

* * * * *